US006619979B1

(12) United States Patent
Yu-Feng

(10) Patent No.: US 6,619,979 B1
(45) Date of Patent: Sep. 16, 2003

(54) TOP-CONTACTING INSERTION SOCKET FOR FLAT CABLE

(76) Inventor: Yen Yu-Feng, 7F, No. 379, Jung Shan Rd., San Chung City, Taipei Hsien (TW)

( * ) Notice: Subject to any disclaimer, the term of this patent is extended or adjusted under 35 U.S.C. 154(b) by 0 days.

(21) Appl. No.: 10/161,422

(22) Filed: Jun. 1, 2002

(51) Int. Cl.[7] ..... H01R 12/24
(52) U.S. Cl. ..... 439/495; 439/260
(58) Field of Search ..... 439/495, 260

(56) References Cited

U.S. PATENT DOCUMENTS 5,476,393 A * 12/1995 Narita ..... 439/495
6,056,572 A * 5/2000 Matsumoto et al. ..... 439/495
6,267,620 B1 * 7/2001 Ma ..... 439/495
6,319,033 B1 * 11/2001 Ma ..... 439/495
6,383,016 B1 * 5/2002 Ma ..... 439/495
6,394,838 B1 * 5/2002 Yen ..... 439/495

* cited by examiner

*Primary Examiner*—Gary Paumen
(74) *Attorney, Agent, or Firm*—W. Wayne Liauh

(57) ABSTRACT

A top-contacting insertion socket for flat cable includes a main body formed of a plurality of terminal cavities for each receiving a terminal therein, and a top cover pivotally connected to a top of the main body and upward turnable to expose the terminal cavities and enable easy insertion of a flat cable into the terminal cavities. A space is left between an inner top surface of the main body and internal connecting pins of the terminals for a tongue portion of the top cover to insert thereinto, such that the tongue portion is pressed at a lower side against the internal connecting pins for a lower side of which to electrically contact with a bare upper side of the flat cable located below the internal connecting pins.

2 Claims, 5 Drawing Sheets

TOP-CONTACTING INSERTION SOCKET FOR FLAT CABLE

BACKGROUND OF THE INVENTION

The present invention relates to a top-contacting insertion socket for flat cable, and more particularly to an insertion socket having a top cover that could be upward turned to expose terminal cavities provided in the insertion socket for a flat cable to easily insert thereinto.

Soft flat cables are mainly used in integrated circuit boards to connect different circuits. For this purpose, there are many relatively small insertion sockets provided on the circuit boards for flat cables to insert thereinto. To enable effective contact with bare ends of the flat cable, the insertion socket is normally designed in two ways, namely, a bottom-contacting type as shown in FIG. 1, and a top contacting type as shown in FIG. 2.

Please refer to FIG. 1. The flat cable 10 has a bare side 11 provided at a lower side thereof to contact with contacts 22 provided on terminals 21 located in the insertion socket 20. Thus, the insertion socket 20 is a bottom-contacting insertion socket. And, in FIG. 2, the flat cable 10 has a bare side 12 provided at an upper side thereof to contact with contacts 32 provided on terminals 31 located in the insertion socket 30. Thus, the insertion socket 30 is a top-contacting insertion socket.

The bottom-contacting insertion socket 20 includes a cover 23 for compressing the flat cable 10 against the terminals 21 in the insertion socket 20. The cover 23 is located at a top of the bottom-contacting insertion socket 20 and could be easily opened to expose terminal cavities 24 in the insertion socket 20 to facilitate easy insertion of the flat cable 10 into the terminal cavities 24.

On the other hand, the top-contacting insertion socket 30 includes a cover 33 having a tongue portion 34 for inserting into the insertion socket 30 to compress the flat cable 10 against the terminals 31 in the insertion socket 30. Since the cover 33 is located near a bottom of the top-contacting insertion socket 30 to abut on the circuit board 40 and could not be fully opened, an operator is not able to see the terminal cavities 35 in the insertion socket 30. Moreover, since the cover 33 could not be fully opened, it presses the terminals 31 to cause frictional contact of the terminals 31 with the flat cable 10 when the latter is inserted into the insertion socket 30. Therefore, it is possible that the flat cable 10 is not fully inserted into the insertion socket 30 due to a resistance from such frictional contact. That is, it is more difficult to properly insert the flat cable 10 into the insertion socket 30.

SUMMARY OF THE INVENTION

It is a primary object of the present invention to provide a top-contacting insertion socket for flat cable having a top cover that could be upward turned to expose terminal cavities in the insertion socket to facilitate easy and proper insertion of a flat cable into the insertion socket.

In the top-contacting insertion socket for flat cable according to the present invention, a space is left between an inner top surface of a main body of the insertion socket and internal connecting pins of terminals in the insertion socket for a tongue portion of the top cover to insert thereinto, so that the tongue portion presses the internal connecting pins below it against a bare upper side of the flat cable to provide good electrical contact thereat.

Each of the internal connecting pins of the terminals in the top-contacting insertion socket of the present invention may be provided at a lower side with more than two barbs to provide increased number of pressing points against the flat cable and accordingly enhanced electrical performance and reliability.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
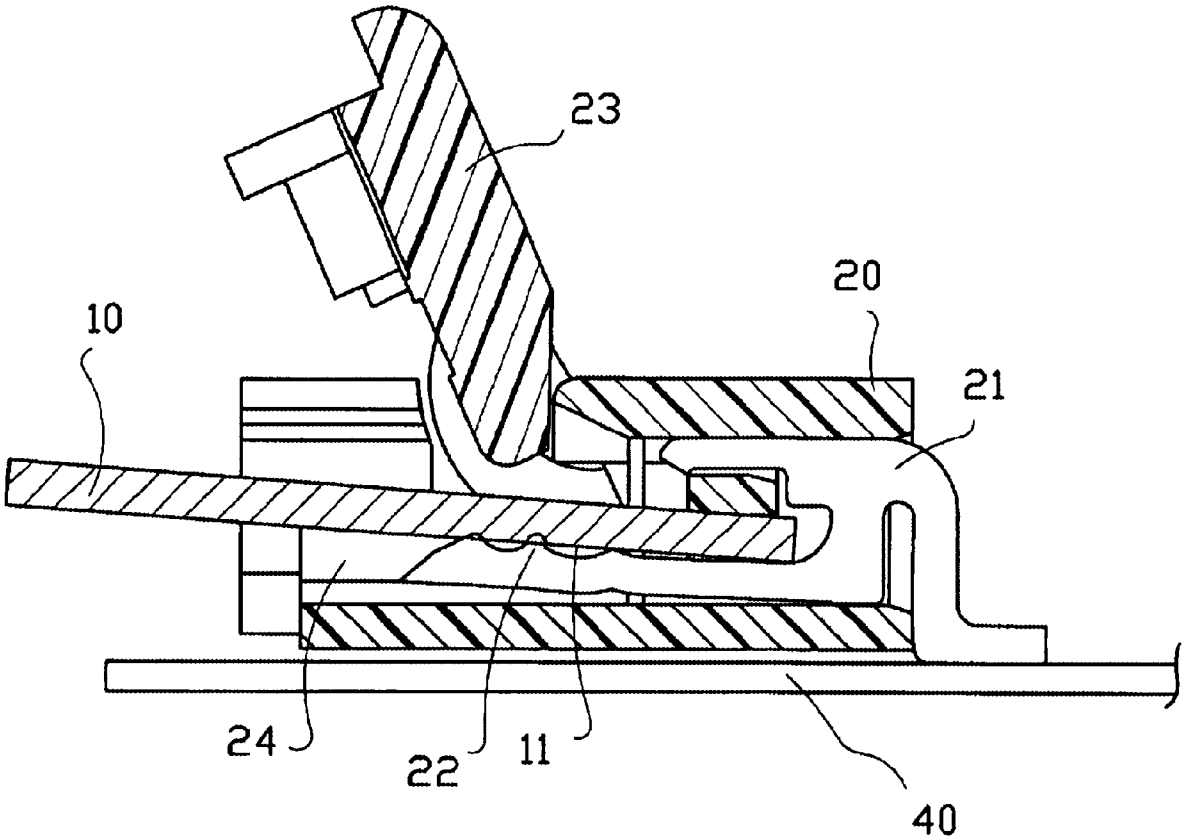
PRIOR ART FIG.1
FIG. 1 is a sectioned side view of a conventional bottom-contacting insertion socket for flat cable.
Figure 2:
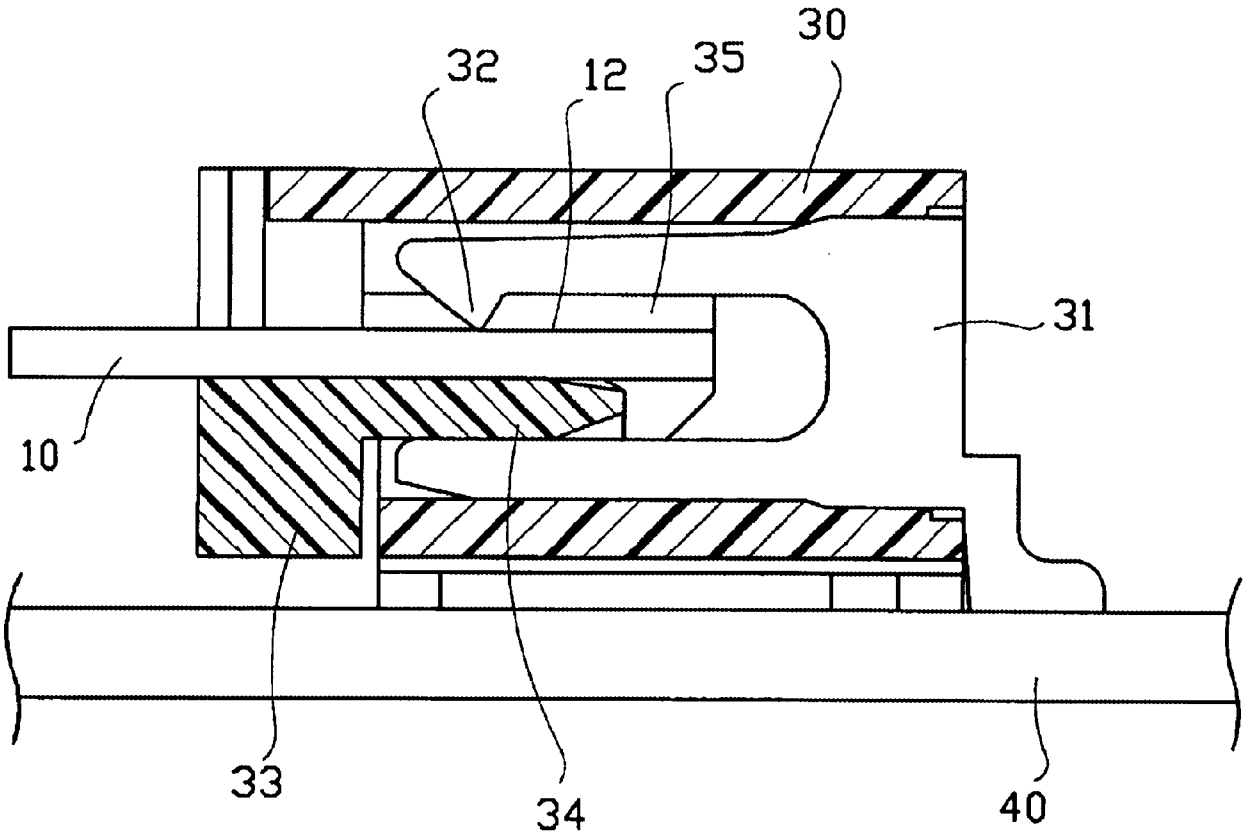
PRIOR ART FIG.2
FIG. 2 is a sectioned side view of a conventional top-contacting insertion socket for flat cable.
Figure 3:
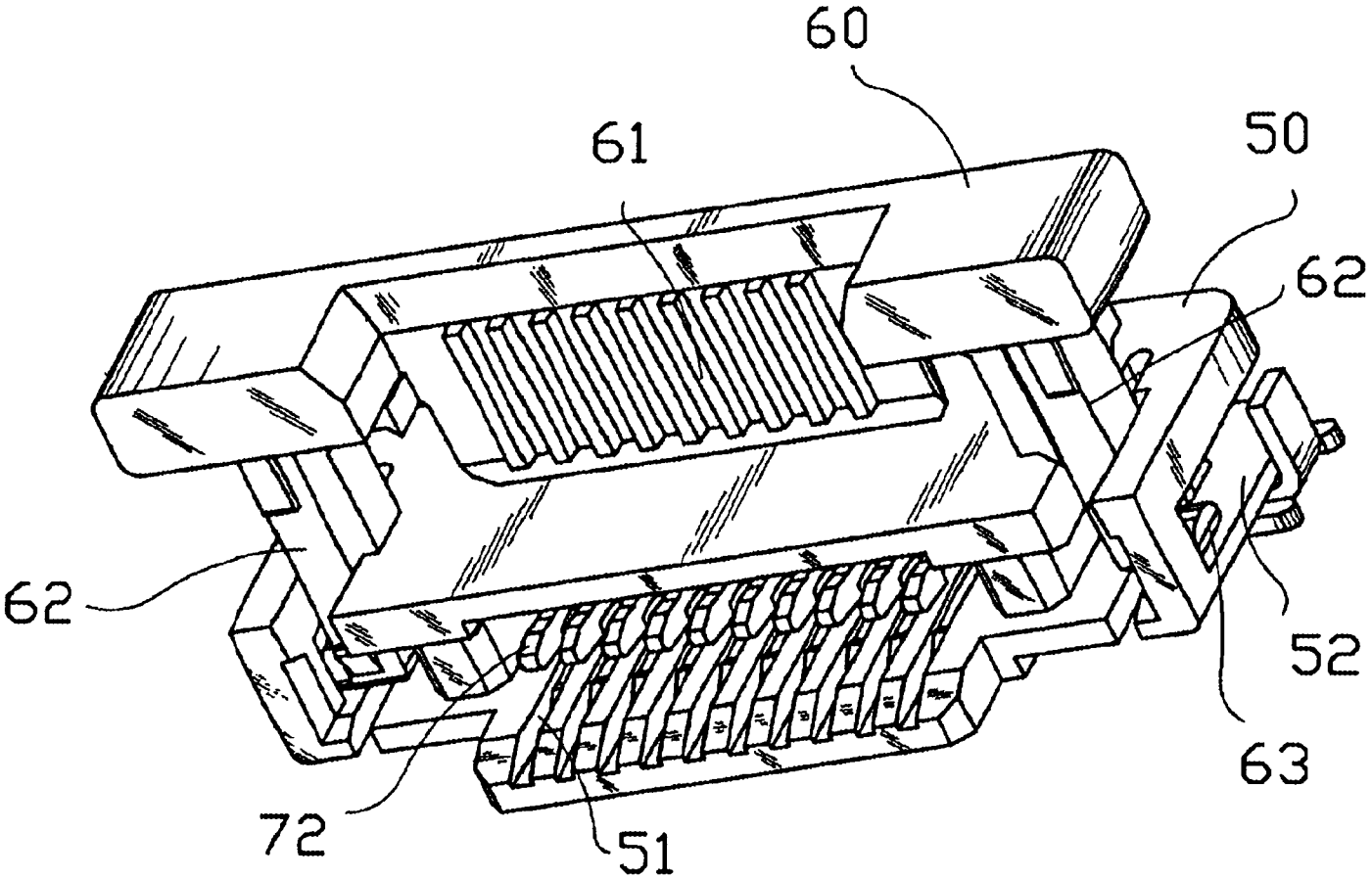
FIG. 3 is a perspective view of a top-contacting insertion socket for flat cable according to the present invention.
Figure 4:
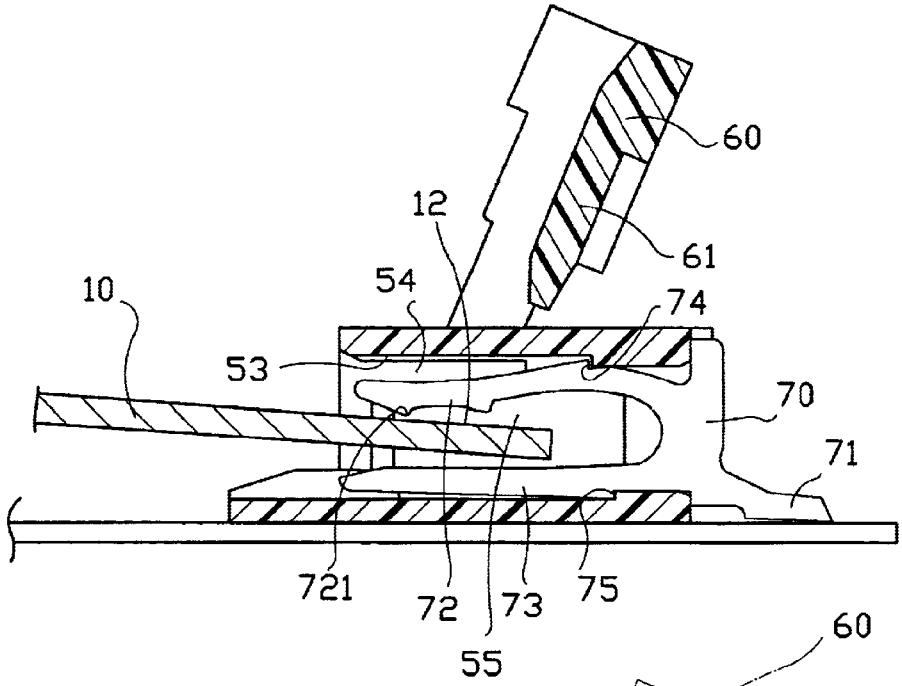
FIG. 4 is a sectioned side view of the top-contacting insertion socket for flat cable of FIG. 3 with a top cover thereof in a lifted position.

Please refer to FIGS. 3 and 4 that are perspective and sectioned side views, respectively, of an insertion socket for flat cable according to the present invention. As shown, the insertion socket includes a main body 50 and a top cover 60 movably connected to a top of the main body 50. The main body 50 is formed of a plurality of terminal cavities 51 for each receiving a terminal 70 therein. Each of the terminals 70 includes a rear end projected from a rear side of the main body 50 to provide an external connecting pin 71, and an upper front end hidden in the terminal cavity 51 to provide an internal connecting pin 72. The top cover 60 includes a central tongue portion 61 and two lateral arm portions 62. Each of the lateral arm portions 62 is provided at a free end with a hook 63 that is engaged with a slide channel 52 provided at each lateral side of the main body 50, such that the top cover 60 is pivotally turnable and linearly movable relative to the main body 50.

Figure 5:
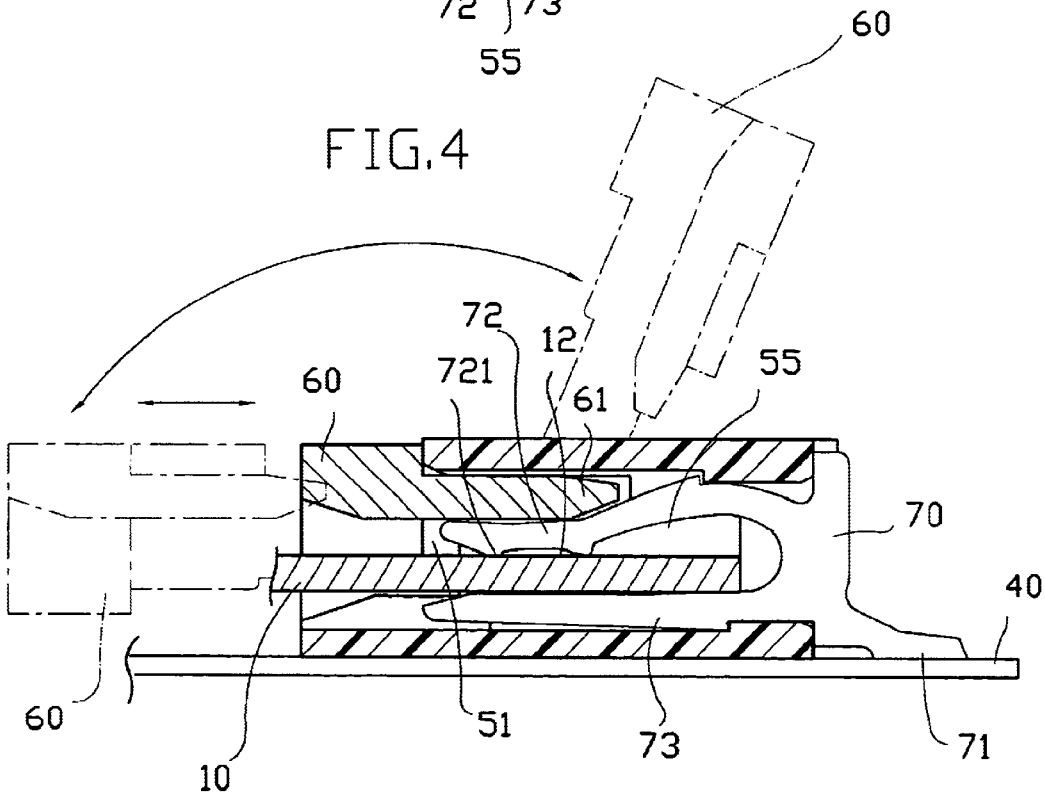
FIG. 5 is a sectioned side view of the top-contacting insertion socket for flat cable of FIG. 3 with a top cover thereof in a closed position.

There is a space 54 left between an inner top surface 53 of the main body 50 and the internal connecting pin 72 of each terminal 70 for the tongue portion 61 of the top cover 60 to insert thereinto. Another space 55 is formed below the internal connecting pin 72 of each terminal 70 in the main body 50 for a flat cable 10 to insert thereinto. When the top cover 60 is turned downward and pushed forward, a lower side of the tongue portion 61 is pressed against tops of the internal connecting pins 72, as shown in FIG. 5, causing barbs 721 separately provided at lower fronts of the internal connecting pins 72 to electrically contact with a bare upper side 12 of the flat cable 10.

The top cover 60 is a tongue-type cover. To expose the terminal cavities 51 of the main body 50 to facilitate easy insertion of the flat cable 10 into the insertion socket, the top cover 60 is first pulled outward to move the tongue portion 61 out of the main body 50 and then pivotally turned upward to a lifted position over the main body 50. The space 54 in the main body 50 for receiving the tongue portion 61 of the top cover 60 is smaller than a thickness of the tongue portion 61, so that the tongue portion 61 inserted thereinto naturally presses the internal connecting pins 72 of the terminals 70 downward for the barbs 721 at the lower fronts of the internal connecting pins 72 to contact with the bare upper side of the flat cable 10.

When the main body 50 is in a state without receiving the tongue portion 61 of the top cover 60 therein, the space 55 below the internal connecting pins 72 is large enough for easy insertion of the flat cable 10 thereinto. That is, the flat cable 10 is not in a frictional contact with the internal connecting pins 72 of the terminals 70.

The barbs 721 provided at the lower front of each internal connecting pin 72 may be two or three in number to provide increased pressing points and accordingly increased holding force against the flat cable 10, as well as enhanced electrical performance and reliability.

When the top cover 60 is lifted as shown in FIG. 4, the terminal cavities 51 in the main body 50 are exposed to external environments, and an operator may easily insert the flat cable 10 into the main body 50 of the insertion socket and visually check whether the flat cable 10 has been fully inserted to ensure reliable assembling of the flat cable 10.

Figure 6:
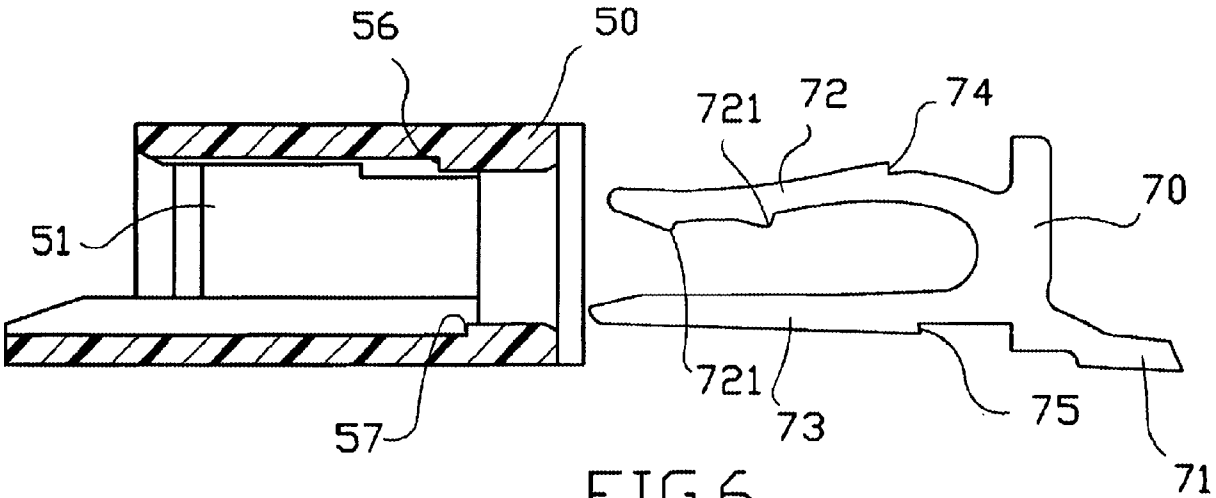
FIG. 6 shows a terminal is to be inserted into the insertion socket of the present invention.
Figure 7:
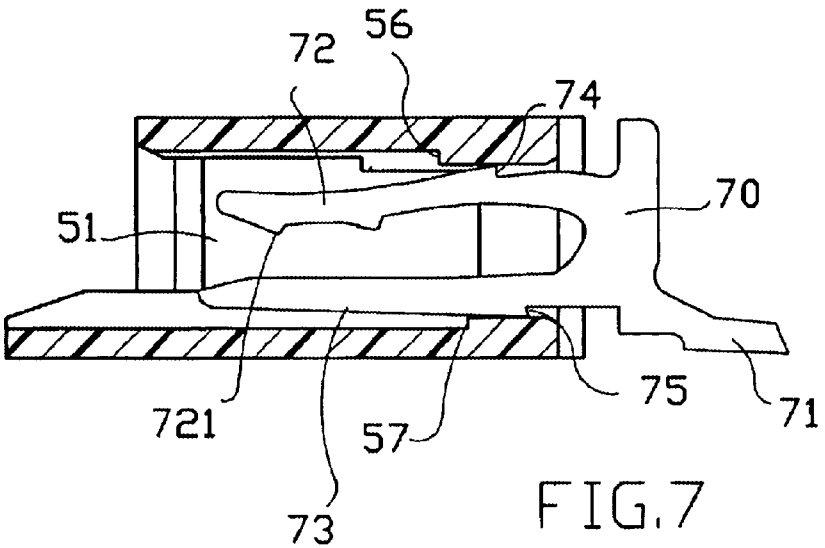
FIG. 7 shows the terminal of FIG. 6 is partially inserted into the insertion socket.

As mentioned above, the top cover 60 has two lateral arm portions having hooks 63 engaged with slide channels 52 correspondingly provided on the main body 50, such that the hooks 63 are movable in the slide channels 52 for the top cover 60 to linearly move and pivotally turn relative to the main body 50 within a limited range. The linear movement of the top cover 60 relative to the main body 50 allows the tongue portion 61 to move into and out of the main body 50 of the insertion socket, and the pivotal turning of the top cover 60 relative to the main body 50 allows easy lifting of the cover 60 to expose the terminal cavities 51. Please refer to FIGS. 6 and 7. Each of the terminals 70 also includes a locating pin 73 below the internal connecting pin 72 and is therefore in the shape of a lying letter U. The pins 72 and 73 are provided at outer sides with projections 74 and 75, respectively. The main body 50 is provided at top and bottom of each terminal cavity 51 with two retaining shoulders 56 and 57, respectively, corresponding to the projections 74 and 75. When the terminal 70 is inserted into the main body 50, both the internal connecting pin 72 and the locating pin 73 could be compressed and deformed to facilitate the insertion of the terminal 70 into the terminal cavity 51. When the terminal 70 is fully inserted into the terminal cavity 51, the internal connecting pin 72 and the locating pin 73 automatically spring outward to engage the projections 74 and 75 with the retaining shoulders 56 and 57, respectively, as shown in FIGS. 4 and 5. That is, the terminal 70 can be located in the terminal cavity 51 without damaging the main body 50.

In brief, the top-contacting insertion socket for flat cable according to the present invention includes an upward openable top cover that can be conveniently lifted to expose the terminal cavities in the insertion socket for easy insertion of a flat cable thereinto even when the insertion socket has been fixedly welded to a circuit board.

What is claimed is:

1. A top-contacting insertion socket for flat cable, comprising a main body and a top cover movably connected to a top of said main body;

said main body being formed of a plurality of terminal cavities for each receiving a terminal therein, each said terminal including a rear end projected from a rear side of said main body to provide an external connecting pin, and an upper front end hidden in said terminal cavity to provide an internal connecting pin; and said top cover including a central tongue portion and two lateral arm portions, each of said lateral arm portions being provided at a free end with a hook that is engaged with a slide channel provided at each lateral side of said main body, such that said top cover is pivotally turnable and linearly movable relative to said main body;

said top-contacting insertion socket for flat cable being characterized in that a first space is left between an inner top surface of said main body and said internal connecting pin of each said terminal for said tongue portion of said top cover to insert thereinto, and a second space is formed below said internal connecting pin of each said terminal in said main body for a flat cable to insert thereinto;

whereby when said cover is turned downward and pushed forward, a lower side of said tongue portion is pressed against tops of said internal connecting pins, causing barbs separately provided at lower fronts of said internal connecting pins to electrically contact with a bare upper side of said flat cable.

2. The top-contacting insertion socket for flat cable as claimed in claim 1, wherein said first space in said main body for said tongue portion of said top cover to insert thereinto is slightly smaller than a thickness of said tongue portion.

* * * * *